United States Patent [19]

Latter

[11] Patent Number: 4,523,748

[45] Date of Patent: Jun. 18, 1985

[54] VERY HIGH PRESSURE APPARATUS FOR QUENCHING

[75] Inventor: Richard Latter, Burke, Va.

[73] Assignee: R & D Associates, Marina del Rey, Calif.

[21] Appl. No.: 529,020

[22] Filed: Sep. 2, 1983

[51] Int. Cl.[3] ..... C21D 9/00

[52] U.S. Cl. ..... 266/249; 425/77; 266/259

[58] Field of Search ..... 425/77; 73/4 R, 837, 73/840, 813, 816, 818, 825; 266/249, 252, 259; 137/68 R

[56] References Cited

U.S. PATENT DOCUMENTS

| | | | |
|---|---|---|---|
| 3,109,553 | 11/1963 | Fike et al. | 137/68 R |
| 3,559,242 | 2/1971 | Marcovitch | 425/DIG. 26 |
| 3,842,665 | 10/1974 | Sober | 73/816 |
| 4,225,300 | 9/1980 | Latter | 425/77 |

FOREIGN PATENT DOCUMENTS

| | | | |
|---|---|---|---|
| 971712 | 10/1964 | United Kingdom | 148/131 |

OTHER PUBLICATIONS

Homan C. G. et al., "Magnetic Moment of Pressure Quenched Cadmium Sulfide", Sol. Sta. Com., vol. 32, pp. 521–524, 1979.

Spain I. L. et al., "Materials Under Pressure", Chemtech, Jun. 1973, pp. 367–378.

*Primary Examiner*—L. Dewayne Rutledge
*Assistant Examiner*—Christopher W. Brody
*Attorney, Agent, or Firm*—Poms, Smith, Lande & Rose

[57] ABSTRACT

A method and apparatus is provided for rapidly "pressure quenching" or reducing the pressure on samples from very high pressures at rates substantially in excess of $10^6$ up to $10^{10}$ bars, or atmospheres, per second, or more, while avoiding damage to the high pressure system. The high pressure system is comparable to that employed to make artificial diamonds, and includes optional arrangements for heating, cooling, and applying electric and magnetic fields to the pressure quenched sample. Special arrangements are provided for circulating cooling fluid in the vicinity of the metastable material to rapidly cool it, immediately prior to decompression.

16 Claims, 5 Drawing Figures

VERY HIGH PRESSURE APPARATUS FOR QUENCHING

FIELD OF THE INVENTION

This invention relates to high pressure techniques, and to arrangements for applying heat, and electric and/or magnetic fields to samples and to pressure reduction arrangements.

BACKGROUND OF THE INVENTION

It is known that certain materials of unique utility and commercial value are in fact theoretically unstable under the normal conditions of their use; that is, they were formed in thermodynamic equilibrium under special conditions of temperature, pressure, magnetic field, etc., and then induced to remain in the same atomic or molecular configuration when the special conditions were removed. Such metastable, "frozen in" structures, thermodynamically out of equilibrium under normal conditions, are examplified by magnets, ordinary glasses, diamonds, cubic boron nitride, and many alloys. Recently it has been found that certain alloys can be temperature quenched extremely rapidly from the molten state to room temperature to produce metallic glasses—solids in which the normal crystalline structure has not had time to form. These materials often have unique and valuable properties. There is reason to believe that under certain conditions another field of new materials exists, comprising substances and/or compositions that can only be formed at high pressures, and having unique densities, internal structure, or other properties, and that may be obtained in a metastable state at ordinary conditions by a process that includes very rapid decompression—removal of the initial confining pressure at a rate so rapid that internal rearrangements of structure cannot be initiated.

Reference is made to an article entitled "Paramagnetic Properties In Pressure Quenched CdS," by R. M. MacCrone, et al., Solid State Coms., Vol. 35 pp. 615–618, Pergamon Press Ltd., 1980. In this article cadmium sulfide was compressed to a pressure above 40 kilobars and then decompressed with a rate "approaching $5\times10^6$ bars per second," or in about 1/25 of a second. It appears that the resulting CdS was at least in part in a different physical form which is metastable and exhibits properties which differ from the normal physical and magnetic properties of cadmium sulfide at room temperatures. However, the relatively slow reduction in pressure of 1/25 second is such that most materials will revert to their normal low pressure state in the course of the reduction in pressure.

Accordingly, a principal object of the present invention is to produce metastable substances or compositions by a process which includes rapid decompression. A further object is to provide a suitable apparatus in which such a process can be safely and usefully carried out.

SUMMARY OF THE INVENTION

When subjected to a sufficiently high pressure many substances and compositions exhibit new solid phases, internal structure, higher density, and related changes in electrical or thermal conductivity or other properties. In the normal cases, however, these high pressure configurations and the resulting changed properties immediately revert to the original low-pressure configuration as soon as the confining pressure is reduced.

Information about the pressure condition is transmitted through the sample at the speed of sound, or in modern terminology, by phonon interaction. When the rate of pressure change is small, only a small movement of the internal bonds or atom positions is necessary to maintain equilibrium with the pressure, and many vibration periods are available to supply energy. Thus, the number of bond distortions that must occur simultaneously is small and the motion is small, so that the entire sample follows the diminishing pressure. Theory shows, however, that some substances and compositions will persist in the high pressure configuration if decompression is accomplished in a time approaching phonon transit time. This would mean that all the bond rearrangements or atom shifts in the sample would be possible at once, or within perhaps 10–100 phonon transits. For the billions of atoms involved, such a change would be a highly improbable event, particularly if the two end states represented lower internal energy levels than the intermediate transitional condition. With the external pressure field vanished, the lattice forces in certain cases are such that the high pressure configuration is stabilized for lack of sufficient local energy to begin the transition.

A new family of substances or materials may, therefore, be formed in a persistent metastable state obtainable only if decompression can be accomplished rapidly. A simple calculation shows what "rapid" means in this context. If the sample has a thickness of 5 mm (0.005 m) and the speed of sound in the composition is 3000 m/sec., then the phonon transit time is $0.005/3000=1.67$ microseconds. If the decompression must be accomplished with 1 phonon transit, then the allowable decompression rate from 20,000 bars will be $20{,}000/1.6\times10^{-6}=1.2\times10^{10}$ bars per second. In practice some tens or hundreds of phonon transits may be tolerable, so a working range of $10^7$ (ten million) to $10^{10}$ bars per second is contemplated for the present invention.

Although high temperatures are often helpful in the formation of a high temperature configuration, the resulting high level of vibrational energy also assists in the reversion to the original state when pressure is removed. Thus, chilling of the sample before decompression may be employed in accordance with one aspect of the present invention. This chilling should be as rapid as possible to forestall the appearance of undesired low temperature phases or configurations.

The process of this invention, therefore, comprises compressing the starting material to a high pressure, for example, above 10 kilobars, together with such heating, cooling, magnetic fields, electric fields or other concurrent conditions as may be desired to obtain the desired density, configuration and alignment of the material; and then decompressing the material at rates substantially above $10^6$ bars per second under the desired temperature conditions. This process is more fully set out and discussed below.

The apparatus of this invention has been devised specifically to carry out the process described, and may include a high pressure system of the well-known pistoncylinder type with special modifications for temperature control and rapid pressure release. In presses of this type the force on the sample is exerted by a piston travelling in a cylinder that confines the sample. The force is derived from a much larger piston under the impetus of hydraulic pressure. In an ordinary system of this type the compressive force on the sample is released when desired by simply opening a valve in the hydraulic line, so that the oil flows out of the large cylinder; the piston then moves slightly away from the sample, and the pressure on the small piston and thence on the sample is released.

The hydraulic oil is slightly compressible, and the structure and rams of the press are slightly distorted when the system is under high pressure, in the order of thousands of atmospheres, or bars. The opening of the valve could in principle be made very rapid, but this would not ensure a rapid decompression of the sample since a finite flow of oil and a finite amount of motion of the heavy masses of the piston and pressure must occur. Decompression of the sample is effected by the small piston being driven backward slightly, and accelerating with it the large piston and the distorted parts of the press. These masses are so large with respect to the mass of the sample that decompression rates must be slow at first from inertial effects alone.

The apparatus of this invention is a piston-cylinder ram system modified to effect rapid decompression at the sample at rates substantially in excess of $10^6$ bars per second. This is accomplished by addition of special release means that permit the small piston and the sample to be suddenly freed from contact with the heavy ram and large piston. With this much smaller mass to move, the sample can be decompressed some hundreds or thousands of times faster than with the conventional system. The specific forms and the preferred locations of the release means are set forth in detail in the drawings and the accompanying description.

In one embodiment the small piston is backed up by a reservoir of hydraulic fluid which is provided with a frangible member opening to a large release port. When the frangible member breaks, the oil pressure behind the small piston is immediately released, and the pressure on the sample is also released, in a time period estimated to be in the order of 10 microseconds, or 1/100,000 second. With high pressures in the order of 60 bars, this corresponds to a decompression rate of about $6\times10^9$ bars per second.

Other features of the invention which may be employed is the apparatus for particular applications include the following:

(1) Magnetic coils for applying a magnetic field to the sample.

(2) Resistive end plates to be used above and below the sample for heating purposes.

(3) Insulating lining arrangements, optionally including salt, for example, to permit the application of electrical potential to the sample, either for heating or polarization purposes.

(4) Electrical power supply arrangements for applying electrical potential to the sample.

(5) Temperature control ducts for directing fluid, including liquid or gas in proximity to the sample.

(6) Explosive or impact members to precipitate rapid decompression.

In accordance with another aspect of the invention materials may be compressed to a high pressure, for example above 10 kilobars, and heated to an elevated temperature, from in the order of two hundred degress Centigrade up to over 1000 degrees Centigrade; and a magnetic and or electric field may, if desired, be applied to the material. The material is then very rapidly cooled by the application of reduced temperature fluid, for example, to the vicinity of the metastable material; and the material is then brought back to atmospheric pressure, preferably but not necessarily by rapid decompression.

Other objects, features and advantages of the invention will become apparent from a consideration of the following detailed description, and from the accompanying drawings.

A more detailed description of the press and its operation and of the special modifications and their principles is provided below.

DETAILED DESCRIPTION OF THE DRAWINGS

Figure 1:
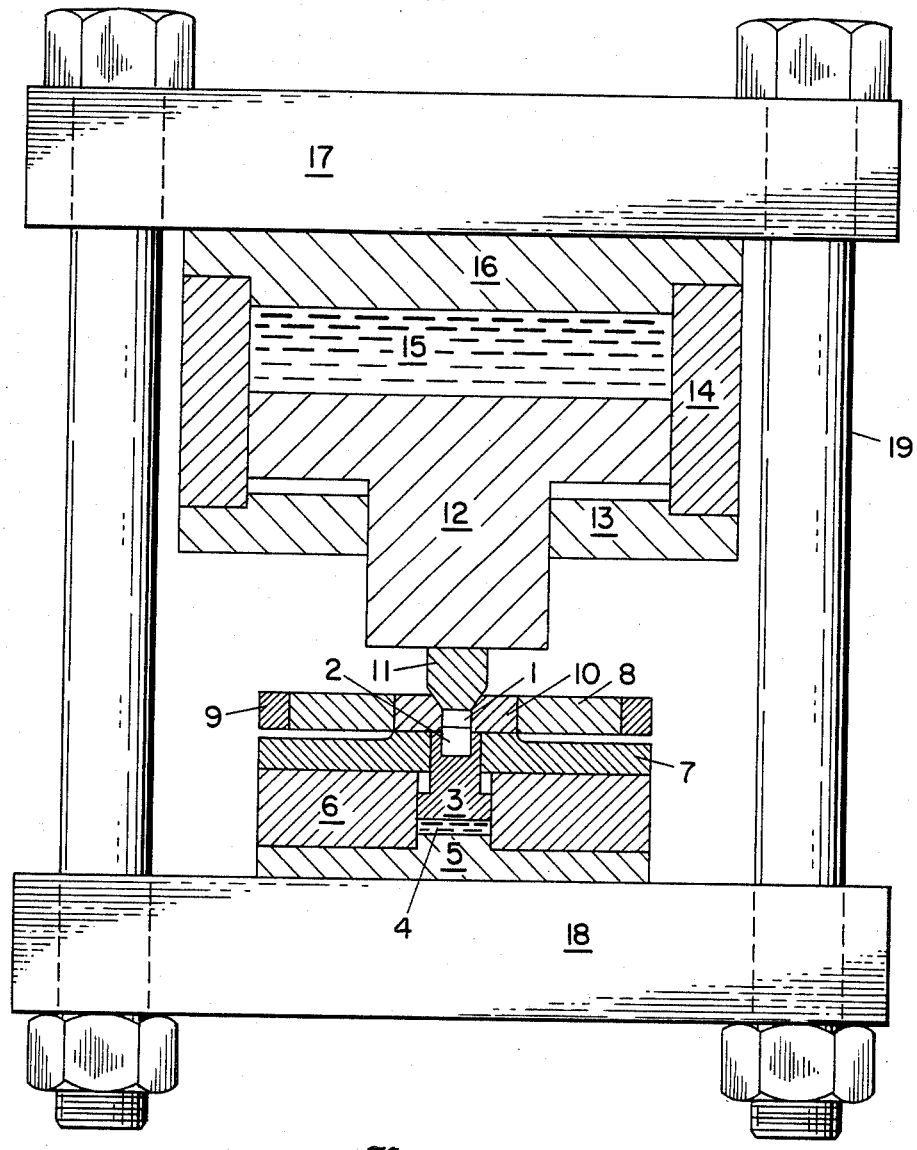
FIG. 1 is a schematic cross-sectional representation of a dual-ram piston-cylinder type high pressure press.

The overall apparatus of this invention is illustrated schematically in FIG. 1. The press is similar to that disclosed previously in U. S. Pat. No. 4,225,300, and in the reference cited in that patent. The sample compartment 1 is enclosed by a cylindrical pressure vessel 10, by an end piece 11 and by a piston 2, driven by secondar ram 3. The upper and lower rams are supported and restrained by a frame of heavy platens 17, 18, and tie-bars 19.

The sample of material to be pressurized is shown at 1, the chamber which confines it is formed by the pressure vessel 10, and the upper and lower pistons 2 and 11. The lower piston 2 is unsupported except by the sample and under the impetus of the rams 3 and 12 moves into the pressure vessel, compressing the sample. The lower oil chamber 4 is part of one of the special fast unloading devices to be described later and is shown here for convenience. In some versions of the unloading device it would not be present. The upper and lower rams are essentially pistons, moving in cylinders formed by close-fitting holes in the ram housings 6 and 14 and driven by hydraulic oil in reservoirs 4 and 15. The lateral sealing of the varous chambers and components is maintained by the end-load pressure of the upper ram, which provides a greater total force than does the small piston 2 which compresses the sample 1. Heating and cooling of the sample area are provided by electric currents and fluid jackets and/or ducts not shown in this drawing.

The pressure vessel 10 is kept under compressive lateral loading by the binding ring 8 and the safety jacket 9. The ram housing 6 supports top plate 7, which opposes the end loading on the pressure vessel 10 exerted by 11. The two hydraulic reservoirs are closed by end plates 5 and 16, supported by press platens 17 and 18, which are in turn retained against the hydraulic pressure by several tie bolts 19, only two of which are shown. Plate 13 centers and supports ram 12 in housing 14.

As mentioned in U.S. Pat. No. 4,225,300, cited above, the press may be made of steel with the parts in immediate proximity to the sample compartment, being of tungsten carbide. Pressures in the order of sixty thousand bars or more are obtained with this apparatus.

One version of the rapid unloading device is illustrated in this drawing. The force of the lower ram is transmitted to the sample through the piston 2. In this version, the mass of the piston and lower ram are kept as small as possible, and the driving oil reservoir is located as close to the sample as possible. Pumping oil at high pressure into this reservoir moves the piston upward, compressing the sample. When it is desired to release this compression rapidly, a special mechanism is actuated to release the oil pressure in 4 suddenly. The special mechanism can be any of several types, one of which is shown in FIG. 2.

Figure 2:
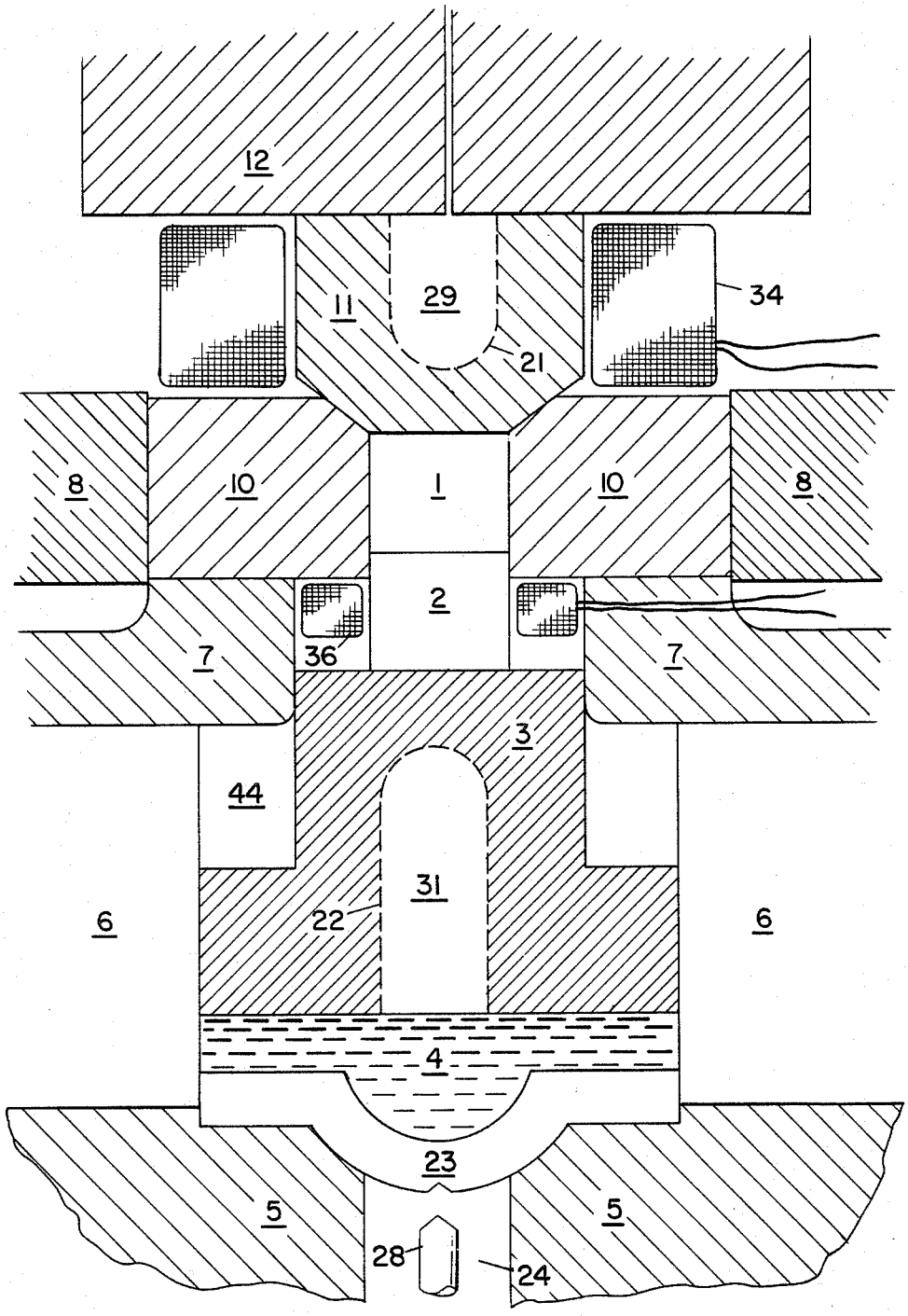
FIG. 2 represents an enlarged sectional view of the central portion of the apparatus of FIG. 1 showing some of the special modifications to the standard press which may be employed to carry out the rapid decompression principles of this invention, and shows electrical coils which may be employed to apply a magnetic field to the sample.

Referring now to FIG. 2, representing an enlargement of the central portion of FIG. 1, the components numbered 1 through 12 represent the same pieces described in FIG. 1, and these are understood to be arranged and supported by the remaining components of FIG. 1 not shown. Three separate means for rapid removal of the pressure on sample 1 are represented schematically in this figure. Quick release of the oil pressure in reservoir 4 can be obtained by the device shown as element 23, which is a high-pressure rupture membrane made of high-strength, brittle metal or special ceramic. This membrane can be designed to fail at the peak pressure desired in each experiment, whereupon the oil and the fractured pieces of the membrance would be ejected through passage 24. Alternatively, a projectile 28 may be driven up through passage 24 to initiate fracture of the membrane 23 when desired.

Piston 11, which normally would be a solid piece of tungsten carbide, can also be used as a means for rapid decompression. With piston 11 being specially proportioned and made with a small cavity 21, this cavity may be loaded with a detonator and explosive charge 29 sufficient to fragment the piston, removing the pressure on the sample 1 very rapidly. The tiny hole needed to pass the detonator wire is not shown in the drawing.

A third example of means suitable for rapid unloading of the compressive force is shown at 22, which represents a cavity in ram 3 suitable for fracturing 3 by the explosive charge 31 mounted therein. Such a charge could also be used to fracture the rupture disc 23, if used.

The electrical coils 34 and 36 may be energized to supply a magnetic field to the sample 1, to align the magnetic domains which may be present in the sample under high temperature conditions. Further, these aligned domains may be frozen in place by the pressure quenching or rapid decompression process.

Figure 3:
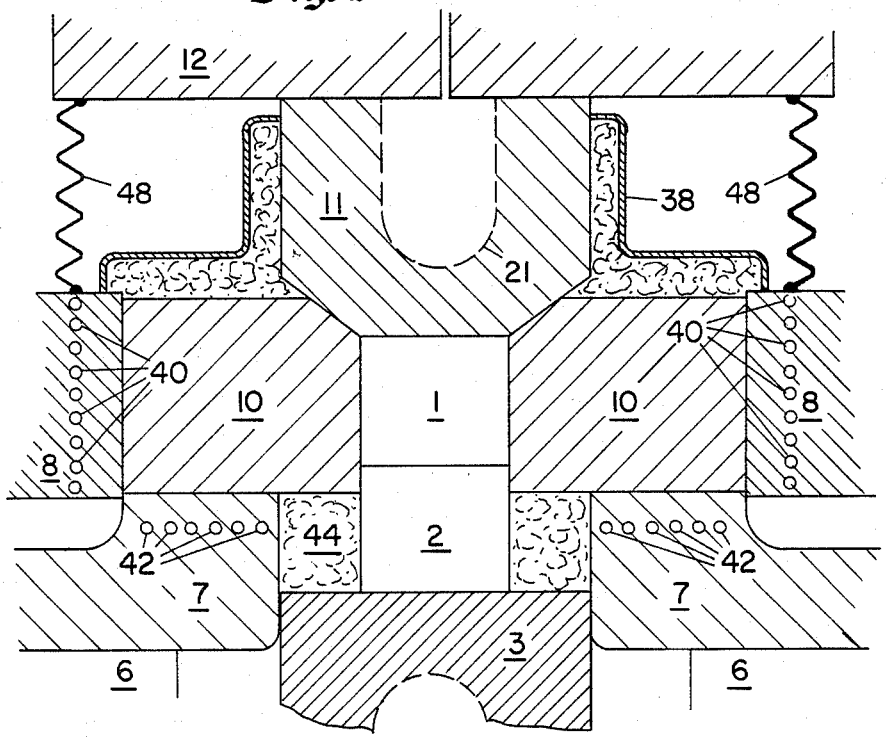
FIG. 3 illustrates temperature control arrangements which may be provided for the system.

FIG. 3 shows temperature control arrangements including the jacket 38 and passageways 40 and 42 in the steel rings 8 and 7, respectively. Gas such as helium or nitrogen, either heated or cooled by heat exchanger 46 (See FIG. 5) may be supplied to casing 38, passageways 40 and 42 and space 44, to heat or cool the sample. Normally, heating would be employed to facilitate the phase change at high pressures, and cooling employed immediately prior to and during rapid pressure release.

When the magnetic coils 34 are employed with the temperature control arrangements, a bellows type enclosing structure 48 may be employed instead of the closer fitting jacket 38.

Figure 4:
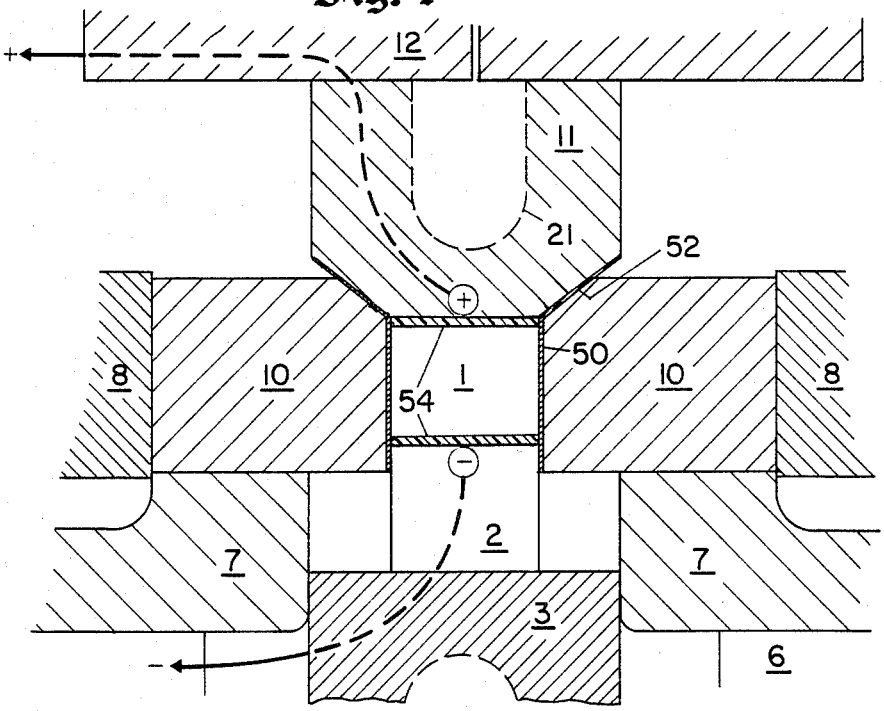
FIG. 4 shows arrangements for applying an electrical potential to the sample for heating it, or for applying an electrical field.

FIG. 4 indicates the application of electrical potential to the top and bottom of the sample 1. The outer periphery of sample 1 may be provided with an insulating lining 50 which is stable at high temperatures and pressures. A potential is therefore applied across the sample 1, and, depending on the resistivity or conductivity of the sample, current may flow through it, or an electric field may be applied across the sample. Short circuiting of the potential applied between the pistons 2 and 11 is prevented by the insulating liner 50 and additional insulating material 52 between members 11 and 10. Salt (NaCl) or other known materials may be employed as the insulating material.

End heaters 54 of resistive material may be provided to increase the temperature, as disclosed in U.S. Pat. No. 4,225,300 cited above.

The process of this invention comprises enclosing the starting material or materials in the sample compartment, advancing the piston 12 to preload the pressure vessel 10, then advancing the piston 2 with ram 3 to compress the sample to the desired degree. In operation, as mentioned briefly above, the sample may be initially compressed to a high pressure up to 60 kilobars or more at a desired temperature (normaly an elevated temperature) as controlled by the application of electrical current and the flow of heated or cooled fluid through the ducts 40, 42 and associated zones 38, 44. If desired, magnetic and/or electric fields may be applied to the sample. Then, after equilibrium is established, the pressure may be abruptly released by the arrangements 21, 22, 23 and/or 24 all as discussed above; and concurrently, if desired, the temperature may be rapidly reduced, by cutting off electrical current, and by providing cooling fluid through ducts 40, 42, and the confined spaces 38, 44.

Figure 5:
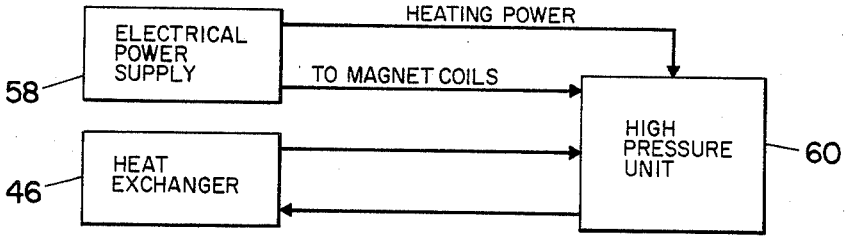
FIG. 5 is a block diagram indicating the electrical power supply and a heat exchanger which may be employed with the high pressure system.

FIG. 5 is a block diagram indicating a power supply 58 for supplying suitable electrical potential or current to the magnet coils and to the sample being processed within the high pressure unit 60 which includes all of the apparatus of FIGS. 1 through 4. The heat exchanger 46 controls the flow of heated or cooling fluid to the passageways 40, 42 and to the zones within the enclosures 38 or 48 and to the volume 44.

It is understood that the illustrations shown in FIGS. 2 through 5 are schematic only, that the details of the devices shown and their dimensions and materials would be adapted to suit the specific experiment, and that the devices can be provided either singly or in multiple.

The principle of operation of the decompression arrangements and of course that could be used, consists of sudden removal or shattering of one or more elements in the pathway by which the pressure is transmitted from the two rams to the sample compartment. To achieve the desired high rate of decompression in the sample of more than $10^6$ up to $10^{10}$ or more bars per second, the pressure pathway must be broken as close to the sample as possible, so that the inertial resistance to expansion of the sample is small. Thus, by way of example are not of limitation, concerning alternatives to the arrangements disclosed above, a rod may extend all of the way through the oil chamber 4, and this rod may have a recess or a hole through it just outside the chamber 4; and by impacting the rod and shifting its position along its length so that the hole is within chamber 4, rapid reduction in pressure may be achieved. Similarly, a rod may be provided with one end extending into oil chamber 4 with a high strength detent preventing it from moving out of the chamber 4; and upon release of the detent, the rod will move out of the chamber, releasing pressure. Accordingly, while the drawings show preferred methods of accomplishing the disclosed effects, they are not intended to be limiting, and other arrangements and devices of similar effect are within the scope of the invention.

What is claimed is:

1. A high pressure quenching apparatus for rapidly decompressing materials so that they remain in metastable states comprising:

means for applying high pressure above 10,000 bars to a sample including:

a press, first and second opposed rams, a preloaded cylindrical pressure vessel, a sample compartment formed by a piston operating in the bore of said pressure vessel;

means for rapidly breaking the continuity of the pathway by which pressure is transmitted from the two rams to the sample compartment, to release the pressure on said sample at a rate equal to or above ten million bars per second;

said means for breaking the continuity including a frangible member;

the first one of said rams being substantially smaller and lighter than the other, wherein hydraulic fluid is included in the pressure transmitting pathway to said first ram, and means is provided for mounting said frangible member in confining relationship with respect to said hydraulic fluid.

2. A high pressure quenching apparatus as defined in claim 1 further including means for heating and cooling said sample.

3. A high pressure quenching apparatus is defined in claim 1 including means for applying a magnetic field to said sample.

4. A high pressure quenching apparatus as defined in claim 1 including means for applying an electrical potential to said sample.

5. A high pressure quenching apparatus as defined in claim 1 including means for selectively directing hot or cold fluid in proximity to said sample to heat or cool said sample.

6. A high pressure quenching apparatus as defined in claim 1 further comprising means for applying a shock to said frangible member to break it.

7. A high pressure quenching apparatus as defined in claim 5 further including heat exchanger means for heating or cooling said fluid.

8. A high pressure quenching apparatus as defined in claim 1, including means for releasing the pressure on said sample at a rate equal to or above $10^8$ bars per second.

9. A high pressure quenching apparatus for rapidly decompressing materials so that they remain in metastable states comprising:

means for applying high pressure above 10,000 bars to a sample including:

a press, first and second opposed rams, a preloaded cylindrical pressure vessel, a sample compartment formed by a piston operating in the bore of said pressure vessel;

means for rapidly breaking the continuity of the pathway by which pressure is transmitted through the two rams to the sample compartment, to release the pressure on said sample at a rate equal to or above ten million bars per second;

said means for breaking the continuity including a frangible member;

the first one of said rams being substantially smaller and ligher than the other, wherein hydraulic fluid is included in the pressure transmitting pathway to said first ram, and means is provided for mounting said frangible member to break the pressure transmitting pathway from said hydraulic fluid to said pressure vessel.

10. A high pressure quenching apparatus as defined in claim 9 further including means for heating and cooling said sample.

11. A high pressure quenching apparatus is defined in claim 1 including means for applying a magnetic field to said sample.

12. A high pressure quenching apparatus as defined in claim 9 including means for applying an electrical potential to said sample.

13. A high pressure quenching apparatus as defined in claim 9 including means for selectively directing hot or cold fluid in proximity to said sample to heat or cool said sample.

14. A high pressure quenching apparatus as defined in claim 9 further comprising means for applying a shock to said frangible member to break it.

15. A high pressure quenching apparatus as defined in claim 13 further including heat exchanger means for heating or cooling said fluid.

16. A high pressure quenching apparatus as defined in claim 9 including means for releasing the pressure on said sample at a rate equal to or above $10^8$ bars per second.

* * * * *